US008448303B1

(12) United States Patent
Wall

(10) Patent No.: US 8,448,303 B1
(45) Date of Patent: May 28, 2013

(54) BELT ADJUSTMENT MECHANISM

(76) Inventor: Henry Wall, Drayton (CA)

( * ) Notice: Subject to any disclaimer, the term of this patent is extended or adjusted under 35 U.S.C. 154(b) by 186 days.

(21) Appl. No.: 13/116,628

(22) Filed: May 26, 2011

(51) Int. Cl.
*A44B 11/24* (2006.01)

(52) U.S. Cl.
USPC ..... 24/194; 24/190; 24/307; 403/109.3; 2/338

(58) Field of Classification Search
USPC ..... 24/68 A, 307, 190, 194, 265 BC, 24/265 WS, 591.1, 594.1, 596.1, 68 E; 224/176; 403/109.1, 109.2, 109.3; 2/321, 338, 339, 2/342
See application file for complete search history.

(56) References Cited

U.S. PATENT DOCUMENTS 2,400,844 A 5/1946 Segal
2,410,759 A 11/1946 Saller
3,017,641 A 1/1962 Stollman
3,150,427 A 9/1964 Rossi
5,491,845 A * 2/1996 Takimoto ..... 2/338
6,108,821 A * 8/2000 Malsoute ..... 2/321
6,148,485 A 11/2000 Wu
2006/0282991 A1* 12/2006 Ross ..... 24/163 K

* cited by examiner

*Primary Examiner* — Robert J Sandy
*Assistant Examiner* — Rowland D Do

(57) ABSTRACT

A belt adjustment mechanism incorporated into a belt that allows an individual to adjust the overall length of the belt, which includes a primary component and an adjustable component that slides within the primary component. Both the primary component and the adjustable component have a pair of tracks and number of holes A hook on each side of the belt adjustment mechanism is placed through tracks of both components and a hole on each of the components to temporarily place the adjustable component into a fixed position in relation to the primary component. A belt is attached to both the primary component and the adjustable component, allowing the actual waist size of the belt to be varied slightly.

4 Claims, 3 Drawing Sheets

BELT ADJUSTMENT MECHANISM

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of belt adjustment mechanism are known in the prior art. However, what is needed is a belt adjustment mechanism incorporated into a belt that allows an individual to easily adjust the overall length of the belt, thereby improving the likelihood of the belt always having a snug yet not too tight fit on an individual.

FIELD OF THE INVENTION

The present invention relates to a belt adjustment mechanism, and more particularly, to a belt adjustment mechanism that provides features and characteristics above and beyond existing belt adjustment mechanisms on which individuals can utilize.

SUMMARY OF THE INVENTION

The general purpose of the present belt adjustment mechanism, described subsequently in greater detail, is to provide a belt adjustment mechanism which has many novel features that result in a belt adjustment mechanism which is not anticipated, rendered obvious, suggested, or even implied by prior art, either alone or in combination thereof.

To accomplish this, the present belt adjustment mechanism comprises a primary component and an adjustable component that slides within the primary component. Both the primary component and the adjustable component have a pair of tracks and number of holes, allowing a hook on each side of the belt adjustment mechanism to be placed through tracks of both components and a hole on each of the components to temporarily place the adjustable component into a fixed position in relation to the primary component. A belt is attached to both the primary component and the adjustable component, allowing the actual waist size of the belt to be varied slightly.

Thus has been broadly outlined the more important features of the present belt adjustment mechanism so that the detailed description thereof that follows may be better understood and in order that the present contribution to the art may be better appreciated.

DETAILED DESCRIPTION OF THE DRAWINGS

Figure 1:
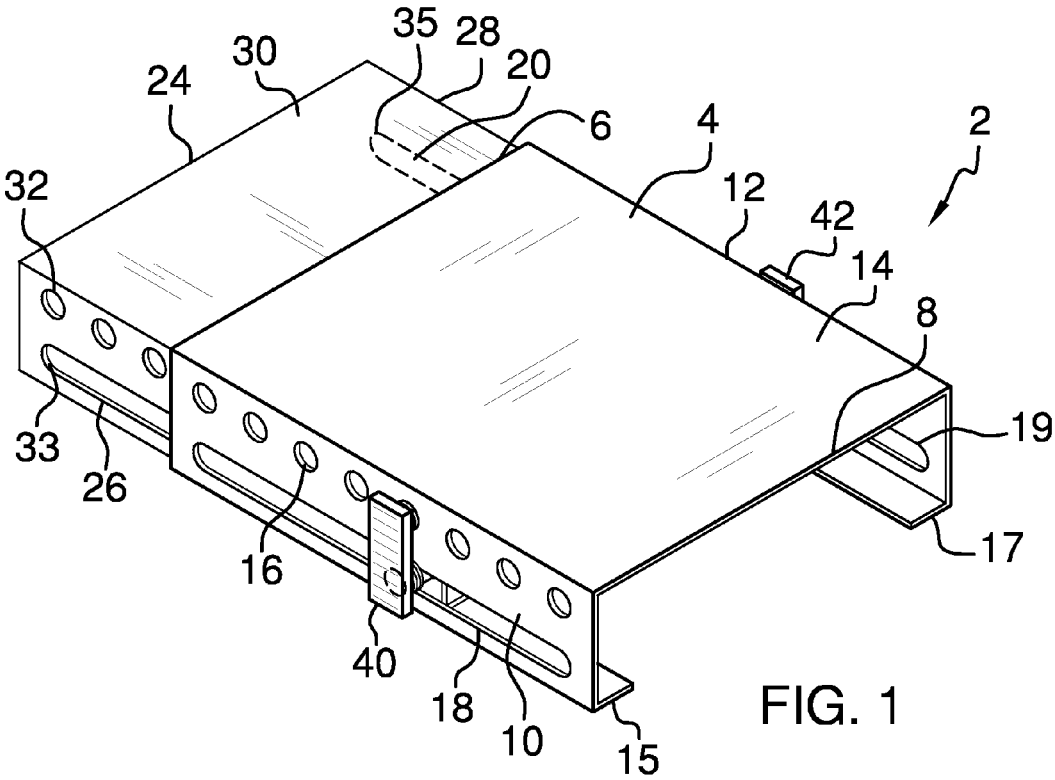
FIG. 1 is an isometric view of the belt adjustment mechanism.
Figure 2:
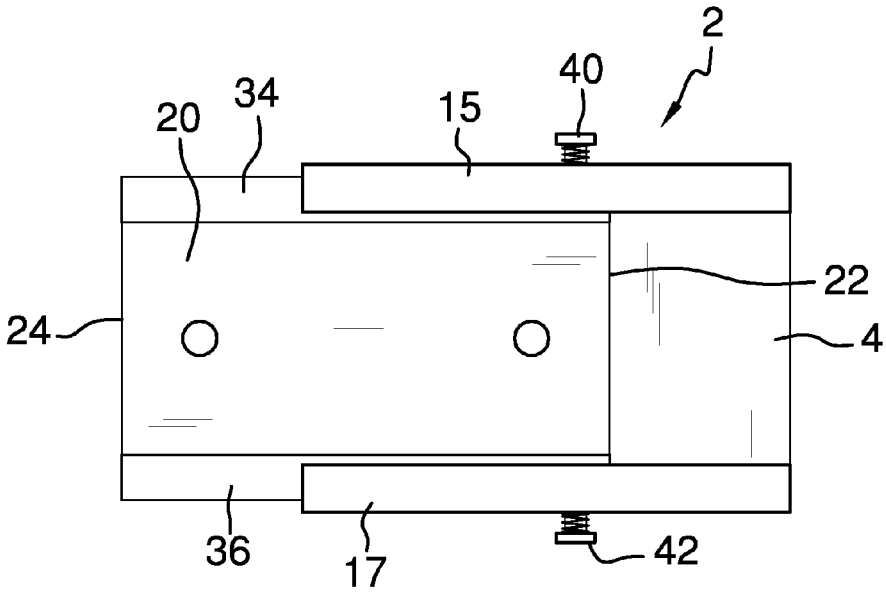
FIG. 2 is a bottom view of the belt adjustment mechanism.
Figure 3:
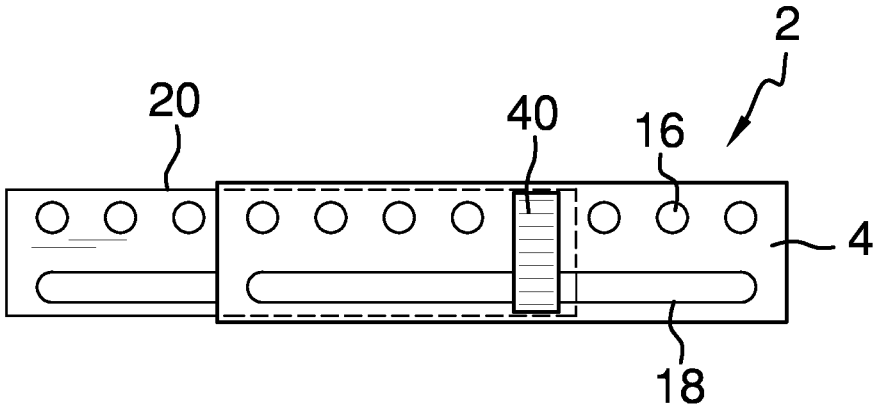
FIG. 3 is a side view of the belt adjustment mechanism.
Figure 4:
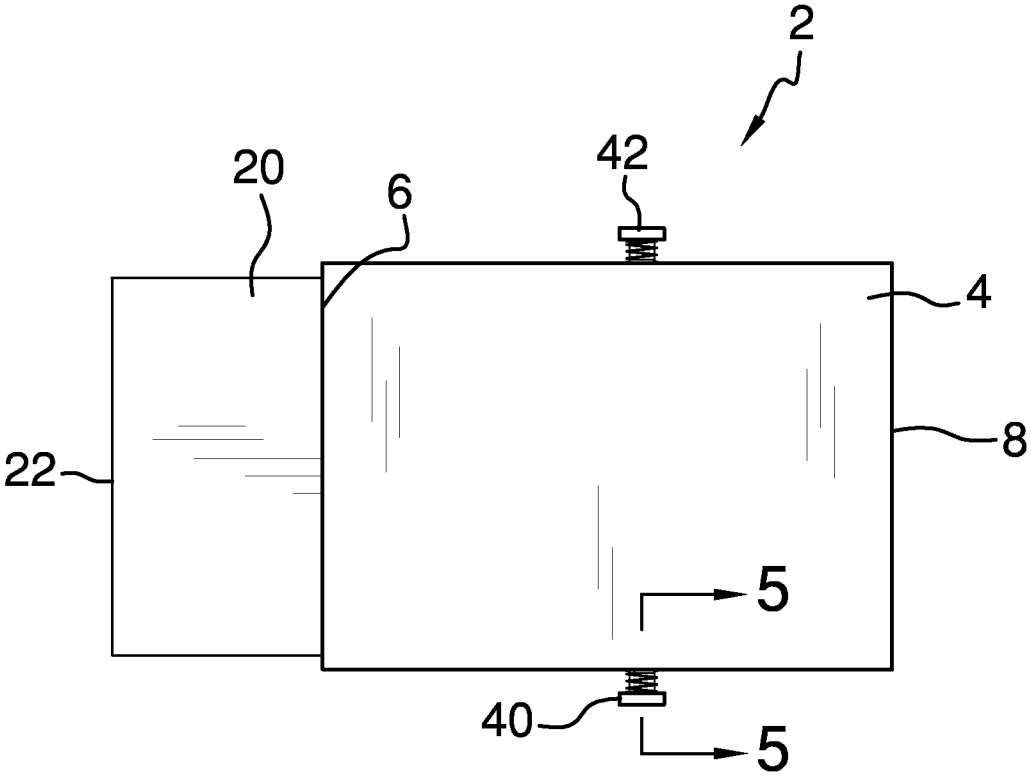
FIG. 4 is a top view of the belt adjustment mechanism.
Figure 5:
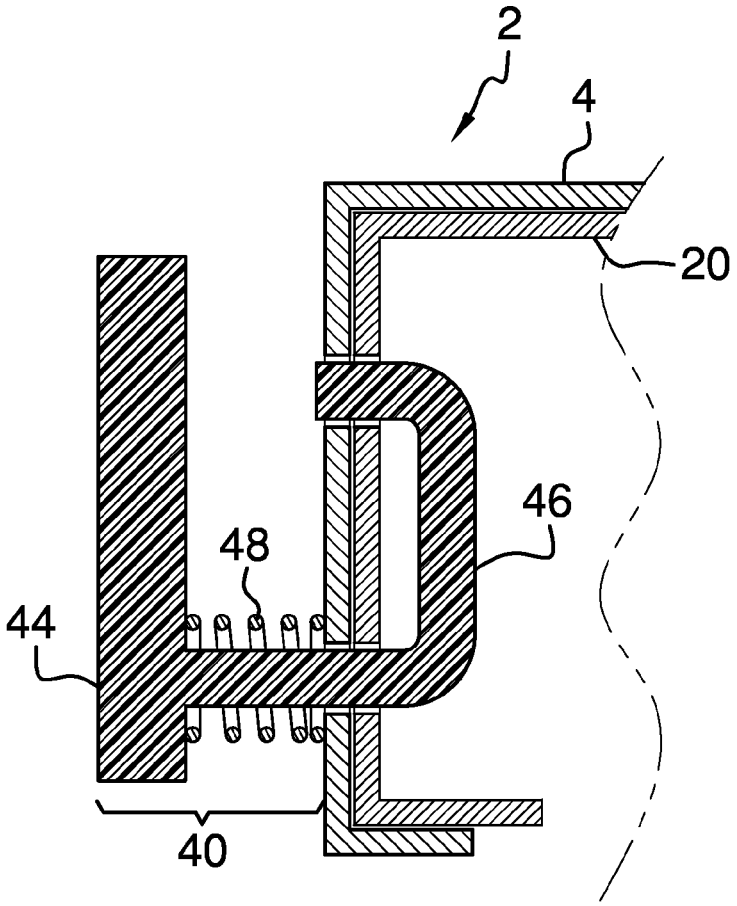
FIG. 5 is a cross-sectional view of the belt adjustment mechanism.
Figure 6:
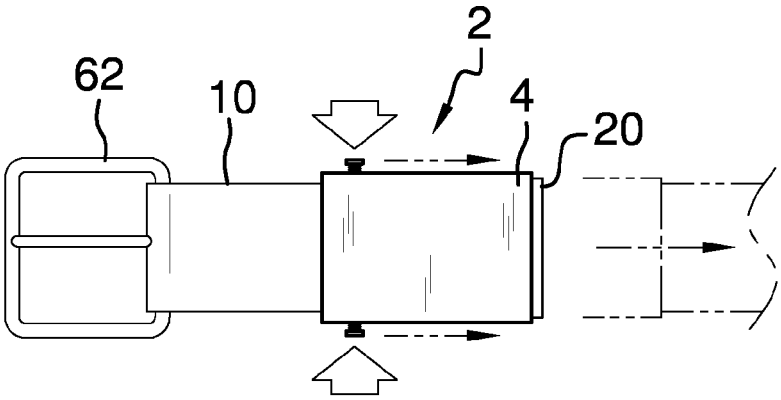
FIG. 6 is a top view of the belt adjustment mechanism as it would appear in use.

With reference now to the drawings, and in particular FIGS. 1 through 6 thereof, an example of the instant belt adjustment mechanism employing the principles and concepts of the present belt adjustment mechanism and generally designated by the reference number 2 will be described.

Referring to FIGS. 1 through 6, a preferred embodiment of the present belt adjustment mechanism 2 is illustrated. The belt adjustment mechanism 2 comprises a primary component 4 that has two ends comprising a first end 6 and a second end 8 and also two sides comprising a first side 10 and a second side 12. The primary component 4 has a top surface 14 but does not have a bottom surface, as it is open.

Each side 10, 12 of the primary component 4 has a plurality of adjustment holes 16 that run lengthwise from the first end 6 of the primary component 4 to the second end 8 of the primary component 4. The adjustment holes 16 are evenly spaced out on each side 10, 12 of the primary component 4 and are fairly close to the top surface 14. The actual number of adjustment holes 16 can vary, but preferably number eight in total on each side 10, 12. Each side 10, 12 of the primary component 4 also has a track 18, 19, respectively, that run lengthwise from the first end 6 of the primary component 4 to the second end 8 of the primary component 4. Tracks 18, 19 are located further away from the top surface 14 than the plurality of holes 16 on each respective side 10, 12.

The primary component 4 also has a pair of flanges 15 and 17, with flange 15 being attached to side 10 and flange 17 being attached to side 12. Each of the flanges 15, 17 run lengthwise from the first end 6 to the second end 6 of the primary component 4 and are located co-planar to where a bottom surface would be located if the primary component 4 actually did have a bottom surface.

The belt adjustment mechanism 2 also comprises an adjustable component 20 that has two ends comprising a first end 22 and a second end 24 and also two sides comprising a first side 26 and a second side 28. The adjustable component 20 has a top surface 30 but does not have a bottom surface, as it is open. The adjustable component 20 is designed to fit within the primary component 4.

Each side 26, 28 of the adjustable component 20 has a plurality of adjustment holes 32 that run lengthwise from the first end 22 of the adjustable component 20 to the second end 24 of the adjustable component 20. The adjustment holes 32 are evenly spaced out on each side 26, 28 of the adjustable component 20 and are fairly close to the top surface 30. The actual number of adjustment holes 32 can vary, but preferably number eight in total on each side 26, 28. The distance between adjustment holes 32 on the sides 26, 28 are the same as the distance between adjustment holes 16 on the sides 10, 12.

Each side 26, 28 of the adjustable component 20 also has a track 33, 35, respectively, that runs lengthwise from the first end 22 of the adjustable component 20 to the second end 24 of the adjustable component 20. Each track 33, 35 is located further away from the top surface 30 than the plurality of holes 32 on each respective side 26, 28.

The adjustable component 20 also has a pair of flanges 34 and 36, with flange 34 being attached to side 26 and flange 36 being attached to side 28. Each of the flanges 34, 36 run lengthwise from the first end 22 to the second end 24 of the adjustable component 20 and are located co-planar to where a bottom surface would be located if the adjustable component 20 actually did have a bottom surface. When the adjustable component 20 is inserted into the primary component 4, the flanges 15, 17 of the primary component 4 help to retain the adjustable component 20 within the primary component 4 by restraining the flanges 34, 36 of the adjustable component 20.

The belt adjustment mechanism 2 also has a pair of locks 40 and 42. Lock 40 is associated with the first side 10 of the primary component 4 and first side 26 of the adjustable component 20, while lock 42 is associated with the second side 12 of the primary component 4 and second side 28 of the adjustable component 20. Each of the locks 40, 42 serves to removably connect the adjustable component 20 of the belt adjustment mechanism 2 to the primary component 4 of the belt adjustment mechanism 2 in a specific position. Each lock includes a central nob 44 for grasping and a hook 46. Each hook 46 is designed to travel through a pair of tracks, one of which is located on the primary component 4 and one of which is located on the adjustable component 20. The hook 46 then loops around and travels outward through a pair of holes, one of which is located on the adjustable component 20 and one of which is located on the primary component 4. Utilizing the hooks in this matter helps to set up the adjustable component 20 in a temporarily fixed position relative to the primary component 4.

Each hook has an area in between the nob 44 and the primary component 4 where a spring 48 is located. Each spring 48 is normally in an extended position and applies outward pressure against both the associated nob 44 and the primary component 4. The spring keeps pressure on the nob 44 and pushes it outward, thereby keeping the respective hook 46 located in both of the tracks and holes on the primary component 4 and the adjustable component 20 pertaining to the sides of the primary component 4 and the adjustable component 20 to which it is associated.

In order to move the adjustable component 20 in relation to the primary component 4, both of the nobs 44 should be pressed inward, thereby freeing the hooks 46 from connection with their associated holes. Then, the adjustable component 20 can be slid around within the primary component 4. Finally, pressure on the nobs 44 can be released to allow the respective hooks 46 to be inserted through holes both in the adjustable component 20 and the primary component 4, thereby temporarily locking the adjustable component 20 in a fixed position relative to the primary component 4.

A belt 60 and an associated buckle 62 are also associated with the belt adjustment mechanism 2. The belt 60 itself is attached to both the primary component 4 and the adjustable component 20, allowing the actual waist size of the belt to be varied slightly as needed.

What is claimed is:

1. A belt adjustment mechanism comprising:

a primary component, the primary component having two ends comprising a first end and a second end, the primary component further having two sides comprising a first side and a second side, the primary component also having a top surface;

an adjustable component, the adjustable component having two ends comprising a first end and a second end, the adjustable component further having two sides comprising a first side and a second side, the adjustable component also having a top surface;

a belt, wherein the belt is attached to the primary component, further wherein the belt is attached to the adjustable component;

wherein the adjustable component is fitted within the primary component;

wherein the belt adjustment mechanism further comprises:

a first pair of flanges comprising a first flange and a second flange, wherein the first flange of the first pair of flanges is attached to the first side of the primary component, further wherein the second flange of the first pair of flanges is attached to the second side of the primary component;

a second pair of flanges comprising a first flange and a second flange, wherein the first flange of the second pair of flanges is attached to the first side of the adjustable component, further wherein the second flange of the second pair of component;

wherein each of the flanges of the first pair of flanges on the primary component help to retain the adjustable component within the primary component after the adjustable component has been fitted into the primary component by restraining each flange of the second pair of flanges;

a first plurality of adjustment holes located on the first side and the second side of the primary component; wherein the holes on each side of the primary component run lengthwise from the first end of the primary component to the second end of the primary component; wherein the holes on each side of the primary component are evenly spaced out; wherein the holes on each side of the primary component are fairly close to the top surface of the primary component;

a first pair of tracks comprising a first track and a second track, wherein the first track is located on the first side of the primary component, further wherein the second track is located on the second side of the primary component, wherein each of the tracks runs lengthwise from the first end of the primary component to the second end of the primary component, wherein the track on each respective side of the primary component is located further away from the top surface than the respective plurality of holes on the respective side of the primary component;

a second plurality of adjustment holes located on the first side and the second side of the adjustable component; wherein the holes on each side of the adjustable component run lengthwise from the first end of the adjustable component to the second end of the adjustable component; wherein the holes on each side of the adjustable component are evenly spaced out; wherein the holes on each side of the adjustable component are fairly close to the top surface of the adjustable component;

a second pair of tracks comprising a first track and a second track, wherein the first track is located on the first side of the adjustable component, further wherein the second track is located on the second side of the adjustable component, wherein each of the tracks runs lengthwise from the first end of the adjustable component to the second end of the adjustable component, wherein the track on each respective side of the adjustable component is located further away from the top surface than the respective plurality of holes on the respective side of the adjustable component;

a pair of locks comprising a first lock and a second lock; wherein the first lock of the pair of locks is associated with the first side of the primary component and the first side of the adjustable component, further wherein the second lock of the pair of locks is associated with the second side of the primary component and second side of the adjustable component;

wherein each lock of the pair of locks serves to removably connect the adjustable component of the belt adjustment mechanism to the primary component of the belt adjustment mechanism.

2. A belt adjustment mechanism according to claim 1 wherein each lock of the pair of locks further comprises:

a hook, a nob, wherein the nob is attached to the hook;

wherein each hook is designed to travel through a track on the adjustable component and a track on the primary component, further wherein the hook loops around and travels outward through a hole of the second plurality of adjustment holes on the adjustable component and a hole of the first plurality of adjustment holes on the primary component.

3. A belt adjustment mechanism according to claim 2 wherein each lock of the pair of locks further comprises a spring, wherein the spring is located in an area in between the nob associated with the respective lock to which the spring is associated and the primary component, further wherein each spring is normally in an extended position and applies outward pressure against the respective nob and the primary component, thereby keeping the respective hook located in both the track and a number of holes.

4. A belt adjustment mechanism comprising:

a primary component, the primary component having two ends comprising a first end and a second end, the primary component further having two sides comprising a first side and a second side, the primary component also having a top surface;

an adjustable component, the adjustable component having two ends comprising a first end and a second end, the adjustable component further having two sides comprising a first side and a second side, the adjustable component also having a top surface;

a belt, wherein the belt is attached to the primary component, further wherein the belt is attached to the adjustable component;

wherein the adjustable component is fitted within the primary component;

a first pair of flanges comprising a first flange and a second flange, wherein the first flange of the first pair of flanges is attached to the first side of the primary component, further wherein the second flange of the first pair of flanges is attached to the second side of the primary component;

a second pair of flanges comprising a first flange and a second flange, wherein the first flange of the second pair of flanges is attached to the first side of the adjustable component, further wherein the second flange of the second pair of flanges is attached to the second side of the adjustable component;

wherein each of the flanges of the first pair of flanges on the primary component help to retain the adjustable component within the primary component after the adjustable component has been fitted into the primary component by restraining each flange of the second pair of flanges;

a first plurality of adjustment holes located on the first side and the second side of the primary component; wherein the holes on each side of the primary component run lengthwise from the first end of the primary component to the second end of the primary component; wherein the holes on each side of the primary component are evenly spaced out; wherein the holes on each side of the primary component are fairly close to the top surface of the primary component;

a first pair of tracks comprising a first track and a second track, wherein the first track is located on the first side of the primary component, further wherein the second track is located on the second side of the primary component, wherein each of the tracks runs lengthwise from the first end of the primary component to the second end of the primary component, wherein the track on each respective side of the primary component is located further away from the top surface than the respective plurality of holes on the respective side of the primary component;

a second plurality of adjustment holes located on the first side and the second side of the adjustable component; wherein the holes on each side of the adjustable component run lengthwise from the first end of the adjustable component to the second end of the adjustable component; wherein the holes on each side of the adjustable component are evenly spaced out; wherein the holes on each side of the adjustable component are fairly close to the top surface of the adjustable component;

a second pair of tracks comprising a first track and a second track, wherein the first track is located on the first side of the adjustable component, further wherein the second track is located on the second side of the adjustable component, wherein each of the tracks runs lengthwise from the first end of the adjustable component to the second end of the adjustable component, wherein the track on each respective side of the adjustable component is located further away from the top surface than the respective plurality of holes on the respective side of the adjustable component;

a pair of locks comprising a first lock and a second lock, wherein each lock of the pair of locks further comprises a hook, wherein each lock of the pair of locks further comprises a nob, wherein the nob is attached to the hook, wherein each hook is designed to travel through a track on the adjustable component and a track on the primary component, further wherein the hook loops around and travels outward through a hole of the second plurality of adjustment holes on the adjustable component and a hole of the first plurality of adjustment holes on the primary component, wherein each lock of the pair of locks further comprises a spring, wherein the spring is located in an area in between the nob associated with the respective lock to which the spring is associated and the primary component, further wherein each spring is normally in an extended position and applies outward pressure against the respective nob and the primary component, thereby keeping the respective hook located in both the track and a number of holes, wherein the first lock of the pair of locks is associated with the first side of the primary component and the first side of the adjustable component, further wherein the second lock of the pair of locks is associated with the second side of the primary component and second side of the adjustable component; and wherein each lock of the pair of locks serves to removably connect the adjustable component of the belt adjustment mechanism to the primary component of the belt adjustment mechanism.

* * * * *